US009091409B2

(12) United States Patent
Hu et al.

(10) Patent No.: US 9,091,409 B2
(45) Date of Patent: Jul. 28, 2015

(54) HIGH RECYCLING EFFICIENCY SOLID STATE LIGHT SOURCE DEVICE

(71) Applicant: APPOTRONICS CORPORATION LIMITED, Shenzhen (CN)

(72) Inventors: Fei Hu, Shenzhen (CN); Yi Li, Pleasanton, CA (US); Yi Yang, Shenzhen (CN)

(73) Assignee: APPOTRONICS CORPORATION LIMITED, Shenzhen (CN)

( * ) Notice: Subject to any disclaimer, the term of this patent is extended or adjusted under 35 U.S.C. 154(b) by 0 days.

(21) Appl. No.: 14/552,238

(22) Filed: Nov. 24, 2014

(65) Prior Publication Data

US 2015/0077974 A1 Mar. 19, 2015

Related U.S. Application Data

(63) Continuation of application No. 13/235,351, filed on Sep. 17, 2011, now Pat. No. 8,919,993.

(51) Int. Cl.

| | |
|---|---|
| ***F21V 7/00*** | (2006.01) |
| ***F21V 9/00*** | (2006.01) |
| ***F21K 99/00*** | (2010.01) |
| ***F21V 13/08*** | (2006.01) |

(52) U.S. Cl.

CPC ..... *F21V 7/0025* (2013.01); *F21K 9/56* (2013.01); *F21V 7/0033* (2013.01); *F21V 13/08* (2013.01)

(58) Field of Classification Search

CPC ... H04N 9/3155; H04N 9/3197; G03B 21/28; G03B 21/204

USPC ..... 362/231, 235, 296.1

See application file for complete search history.

(56) References Cited

U.S. PATENT DOCUMENTS

| | | | | |
|---|---|---|---|---|
| 7,547,114 | B2 | 6/2009 | Li et al. | |
| 7,616,381 | B2 * | 11/2009 | Shen et al. | 359/629 |
| 8,008,694 | B2 | 8/2011 | Xu et al. | |

(Continued)

FOREIGN PATENT DOCUMENTS

WO 2010059614 5/2010

OTHER PUBLICATIONS

International Search Report in the related PCT application No. PCT/US2012/055801, dated Dec. 4, 2012.

(Continued)

*Primary Examiner* — Tracie Y Green

(74) *Attorney, Agent, or Firm* — Chen Yoshimura LLP

(57) ABSTRACT

A light source device includes a LED light source or a wavelength conversion material having a near Lambertian light emitting surface. The light source device includes a light recycling system to reflect small-angle lights (lights closer to the normal direction of the light emitting surface) back to the light source, and a collection system for collecting and outputting large-angle lights (lights farther away from the normal direction). The lights reflected by the light recycling system is scattered by the emitting surface in all directions, where the large-angle scattered lights are collected by the light collection system and the small-angle scattered light is reflected by the light recycling system again. A second excitation light source without wavelength conversion material or a second light source with its own wavelength conversion material may be provided, and the second light is directed to the light emitting surface by appropriate optical components.

20 Claims, 10 Drawing Sheets

(56) References Cited

U.S. PATENT DOCUMENTS

| | | | | |
|---|---|---|---|---|
| 8,840,253 | B2 * | 9/2014 | Kitano | 353/84 |
| 2007/0019408 | A1 | 1/2007 | McGuire, Jr. et al. | |
| 2007/0047078 | A1 | 3/2007 | Li | |
| 2007/0268465 | A1 | 11/2007 | Dewald et al. | |
| 2008/0054281 | A1 | 3/2008 | Narendran et al. | |
| 2008/0074752 | A1 | 3/2008 | Chaves et al. | |
| 2008/0247172 | A1 | 10/2008 | Beeson et al. | |
| 2009/0027631 | A1 * | 1/2009 | Liu et al. | 353/84 |
| 2011/0058145 | A1 | 3/2011 | Conner et al. | |
| 2012/0147332 | A1 | 6/2012 | Huang | |

OTHER PUBLICATIONS

IPRP in the related PCT application No. PCT/US2012/055801, dated Dec. 4, 2012.

* cited by examiner

HIGH RECYCLING EFFICIENCY SOLID STATE LIGHT SOURCE DEVICE

BACKGROUND OF THE INVENTION

1. Field of the Invention

This invention relates to solid state light source devices, and in particular, it relates to solid state light source device using light recycling to increase output brightness.

2. Description of the Related Art

Light emitting diodes (LEDs) have become a popular light source. However, the brightness of LED light sources is often insufficient for certain application areas such as large display devices, headlight for automobiles, stage lighting systems, etc. To improve the brightness of LED light sources, one approach is to increase the input power to each LED chip. But high power increases the demand on heat dissipation, because accumulated heat can cause the temperature of the LED chips to increase, reducing the light generating efficiency of the LED chips. This often results in an upper limit of the brightness of LED light sources. Moreover, large drive current can shorten the life of the LED devices and reduce their reliability. Therefore, the brightness of LED light sources cannot be increased in an unrestricted manner by increasing the drive current.

The light emitted by an LED device or a wavelength conversion material formed on the surface of an LED device typically has a near Lambertian distribution, i.e., its brightness is approximately uniform in all directions. Some techniques have been used to reduce the light distribution angle of a LED light source to increase its brightness. FIG. 13 illustrates a light source device 20 where small-angle lights A from the LED chip 21, i.e. light relatively close to a normal direction perpendicular to the surface of the LED chip, are outputted by an optical component 22 such as a lens, a reflector, an optical fiber, etc. Large-angle lights B, i.e. lights relatively farther away from the normal direction, are reflected by a spherical reflector 23 back toward the LED chip 21. The light reflected back to the LED chip 21 is scattered in all directions by the chip; of the scatter lights, the small-angle lights are output by the optical component 22 and the large-angle lights are reflected by the reflector 23 again. In this way, the large-angle lights are recycled, while the output lights have relatively small divergence angles (i.e. small etendue), resulting in increased brightness of the light source device 20.

SUMMARY OF THE INVENTION

One problem that exists for the light source device shown in FIG. 13 is that, because the spherical reflector 23 has a relatively large aberration for large-angle lights, a significant portion of the large-angle light does not fall on the LED chip 21 after being reflected by the reflector 23, and therefore is not recycled. This reduces the light recycling efficiency of the device.

Accordingly, the present invention is directed to an LED light source that substantially obviates one or more of the problems due to limitations and disadvantages of the related art.

An object of the present invention is to increase the light recycling efficiency of LED light sources.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides a light source device which includes: a first light source having a light emitting surface which emits lights and/or scatters lights into a range of directions including small-angle lights and large-angle lights, the small-angle lights having smaller angles with respect to a normal direction of the light emitting surface than the large-angle lights; and a light recycling system, including two reflectors each disposed on one side of the first light source, for directing the small-angle lights back to the first light source.

In another aspect, the present invention provides a light source device which includes: a sheet shaped light source which emits lights; a light diffuser which diffuses light falling upon it into a range of directions including small-angle lights and large-angle lights, the small-angle lights having smaller angles with respect to a normal direction of the light diffuser than the large-angle lights, the light diffuser being different from the light source; and a light recycling system including two reflectors, wherein the light source and the light diffuser are located between the two reflectors, and wherein the two reflectors direct the small-angle lights from the light diffuser back to the light diffuser.

In another aspect, the present invention provides a method for generating an output light which includes: generating a light by a light emitting surface of a first light source, the light having a range of directions including small-angle lights and large-angle lights, the small-angle lights having smaller angles with respect to a normal direction of the light emitting surface than the large-angle lights; directing the small-angle lights back to the light emitting surface of the light source; and collecting and outputting the large-angle lights.

It is to be understood that both the foregoing general description and the following detailed description are exemplary and explanatory and are intended to provide further explanation of the invention as claimed.

DETAILED DESCRIPTION OF THE PREFERRED EMBODIMENTS

Figure 13:
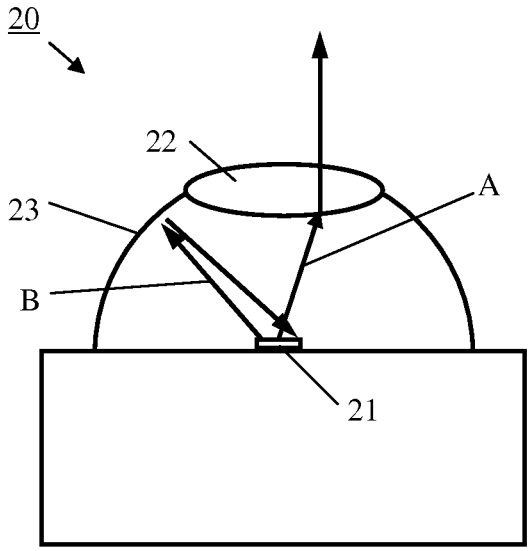
Fig. 13 (Prior Art)
FIG. 13 illustrates a conventional LED device using a spherical reflector to recycle large-angle light.

To solve the above-discussed problem associated with the conventional LED device shown in FIG. 13, a LED light source is designed according to embodiments of the present invention which uses a spherical reflector to recycle small-angle lights and a light collection system to collect large-angle lights for output.

Figure 1:
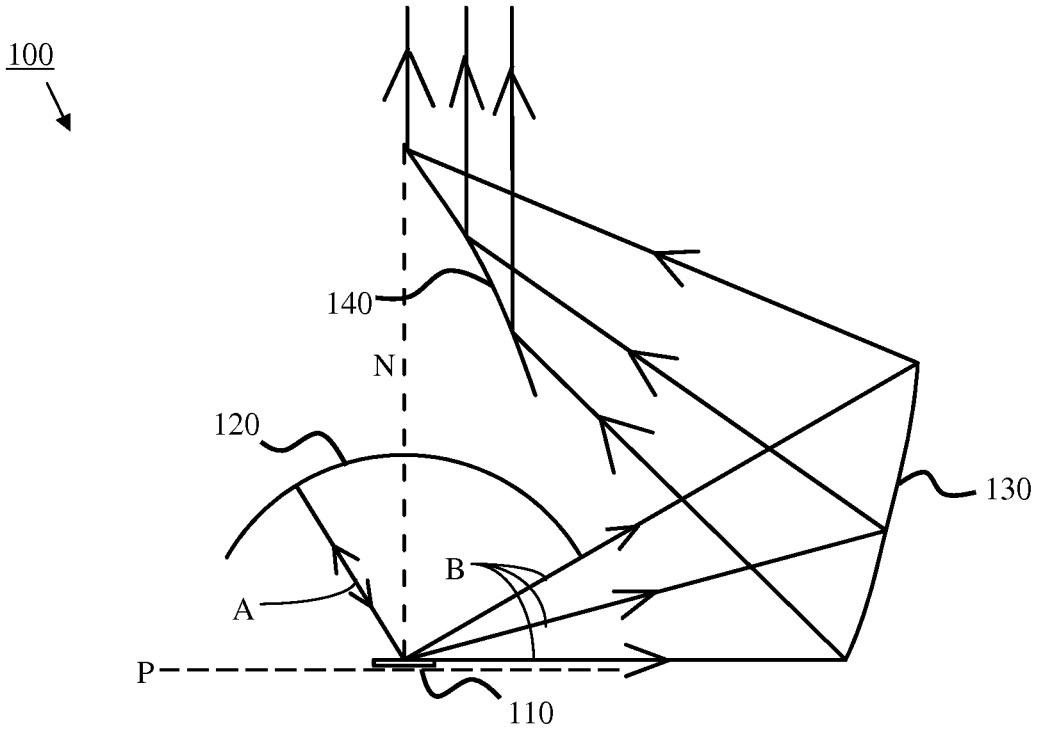
FIG. 1 illustrates a light source device according to a first embodiment of the present invention which uses a spherical reflector to recycle small-angle light and a light collection system to collect large-angle light for output.

FIG. 1 illustrates a light source device according to a first embodiment of the present invention. The light source device 100 includes a light source 110, a light recycling system and a light collection system. The light source 110 may be an LED chip. The LED chip may emit light of a desired color, such as UV, blue, green, red, IR, etc. The LED chip may also include wavelength conversion materials formed on its surface, which converts a shorter wavelength light (e.g., UV, blue, etc.) from the LED to a longer wavelength light (e.g. green, yellow, red, etc.). Preferably, the LED internally has a reflective surface below a light emitting material so that emitted light traveling in the downward direction in the drawing is reflected upwards to present it from being lost. The light recycling system includes a first reflector 120 having a spherical shape, which is disposed above the light source 110 and covers an area near the normal direction N (central axis) of the plane P defined by the light source 110, but does not extend all the way to the plane P of the light source. Thus, small-angle lights A from the light source 110 (i.e. light relatively close to the normal direction) are reflected by the spherical reflector 120 back to the light source 110. The reflector 120 preferably has a high-reflective coating on its inside surface to effectively reflect light.

Large-angle lights B from the light source 110 are collected by the light collection system. The light collection system may be formed of one or more reflectors, or one or more prisms, or one or more lenses, or a combination of reflector (s), prism(s) and lens(es), etc. In the embodiment shown in FIG. 1, the light collection system includes first and second collecting reflectors 130 and 140. The first collecting reflector 130 is disposed further away from the light source 110 than the spherical reflector 120, and reflects the large-angle lights B from the light source in a direction that is generally upwards (i.e. away from the plane P) and inwards (i.e. toward the center axis N). The second collecting reflector 140 is disposed above the spherical reflector 120, and reflects the light from first collecting reflector 130 in a generally upward (vertical) direction in the drawing. Note that FIG. 1 is a cross-sectional view; the shapes of reflectors 123, 130 and 140 preferably have rotational symmetry around the central axis N (to avoid overcrowding, FIG. 1 only illustrates the first and second collecting reflectors 130 and 140 on one side). The shapes and locations of first and second collecting reflectors 130 and 140 are designed such that substantially all of the light from the source 110 not blocked by the first reflector 120 is reflected by the first collecting reflector 130 toward the second collecting reflector 140, and further reflected by the second collecting reflector 140 in a substantially vertical direction in the drawing. In the example shown in FIG. 1, the first collecting reflector 130 converges the light and the second collecting reflector 140 slightly diverges the light (in the cross-sectional view).

Any suitable shapes and locations of first and second collecting reflectors 130 and 140 may be used so long as they effectively collect the large-angle lights B and output them in a desired direction. Preferably, the light collection system maintains the etendue of the emitted light of the light source 110. For example, the reflector 130 and reflector 140 can be rotationally symmetric in shape, or they can be freeform shaped (not rotationally symmetric). In a preferred embodiment, the reflector 130 and reflector 140 are rotationally symmetric aspheric surfaces, but they can also be rotational symmetric spherical surfaces. Or, in order to achieve different light distribution from the light source, the reflector 130 and reflector 140 may be designed to have freeform shapes, defined by various ways, such as non-uniform rotational B-splines, linear interpolation or other higher order polynomial interpolation between calculated points (in the cross-sectional view).

The lights reflected by the light recycling system (spherical reflector 120) back to the light source 110 are partially scattered by the light source 110 in all directions, and partially transmitted into the light source. The light transmitted in the light source will be recycled and some of it will be re-emitted out in all directions. Of the scattered and the re-emitted lights, the large-angle lights are collected by the light collection system (reflectors 130 and 140) and output, and the small-angle lights are reflected again by the spherical reflector 120 back to the light source 110. The reflected small-angle lights will again be partially reflected by the light source, and partially transmitted into the light source, and the process repeats. In this way, the reflector 120 recycles the light. Small-angle lights are recycled by the light recycling system, and large-angle lights are output by the light collection system.

In the configuration shown in FIG. 1, because the light collection system (reflectors 130 and 140) is disposed behind the reflector 120, what light is recycled and what light is outputted is determined by the spatial extent of the reflector 120. The lights that are reflected by the reflector 120 have relatively small angles with respect to the normal direction, and lights outputted by the light collection system have relatively large angles with respect to the normal direction. It should be appreciated that the terms large-angle and small-angle are relative terms.

Because small-angle lights that have small aberration are being reflected by the light recycling system, the light recycling system can effectively reflect substantially all small-angle light back to the light source. Overall, the light recycling system and light collection system described above has very high efficiency and can effectively collect the light emitted by the light source 110 and significantly increase the brightness of the output light.

Figure 2:
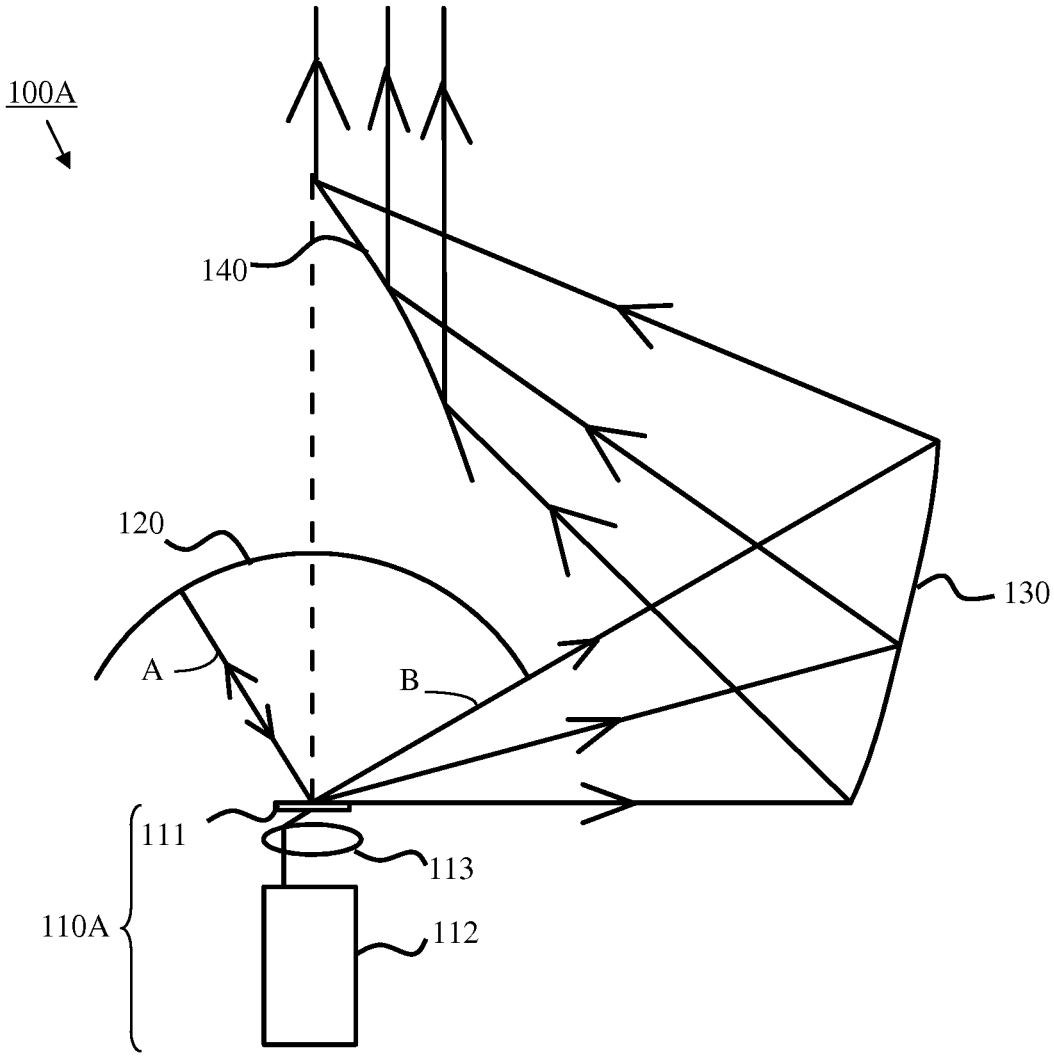
FIG. 2 illustrates a light source device according to a second embodiment of the present invention which uses a wavelength conversion element and remote excitation light as the light source.

FIG. 2 illustrates a light source device according to a second embodiment of the present invention. In the light source device 100A shown in FIG. 2, the light recycling system (first reflector 120) and the light collection system (first and second collecting reflectors 130 and 140) are similar to or the same as the corresponding systems of the first embodiment shown in FIG. 1. The light source 110A includes a wavelength conversion element 111 carrying a wavelength conversion material such as phosphor materials, quantum dots, light emitting dyes, etc., which is illuminated by an external excitation light source 112 delivered via appropriate delivery optical elements 113 (e.g., lens, reflector, optical fiber, etc.). The light emitted from the surface of the light source 110A has a near Lambertian distribution. The excitation light source 112 is preferably an LED emitting in the blue or UV region. The excitation light source 112 may be remotely located relative to the wavelength conversion element 111, so long as appropriate optical elements are used to deliver the light. In particular, the wavelength conversion element 111 may include multiple segments carrying different wavelength conversion materials (or no wavelength conversion material), and may be moveably mounted on a moving system such as a rotating wheel such that the different segments of the wavelength conversion element is alternatingly exposed to the light of the excitation light source 112. A moving wheel carrying wavelength conversion materials is described in commonly owned U.S. Pat. No. 7,547,114.

Figure 2A:
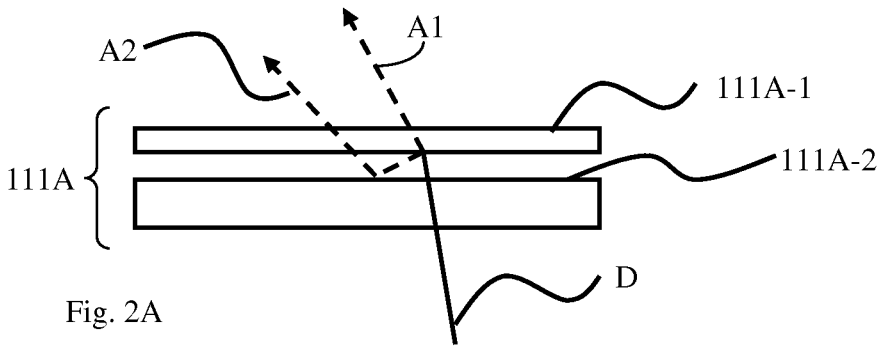
FIGS. 2A and 2B illustrate two implementations of the wavelength conversion element of the embodiment of FIG. 2.

In a preferred implementation, shown in FIG. 2A, the wavelength conversion element 111A, corresponding to the wavelength conversion element 111 of FIG. 2, includes a layer of wavelength conversion material 111A-1 and a dichroic filter 111A-2 which transmits the excitation light D (blue or UV light) and reflects the longer-wavelengths converted light emitted by the wavelength conversion material 111A-1. The dichroic filter 111A-2 is disposed between the wavelength conversion material 111A-1 and the delivery optical elements 113 from which the excitation light is introduced. An air gap is provided between the layer of wavelength conversion material 111A-1 and the dichroic filter 111A-2. The wavelength conversion material 111A-1 emits converted light in both directions; the light A1 in the forward direction travels toward the reflectors 120 and 130, and the light in the backward direction is reflected by the dichroic filter 111A-2 (which acts as a high reflectance mirror for such light) back in the forward direction as light A2. The very high reflectance of the dichroic filter 111A-2 and the reflector 120 together achieve high efficiency recycling.

Figure 2B:
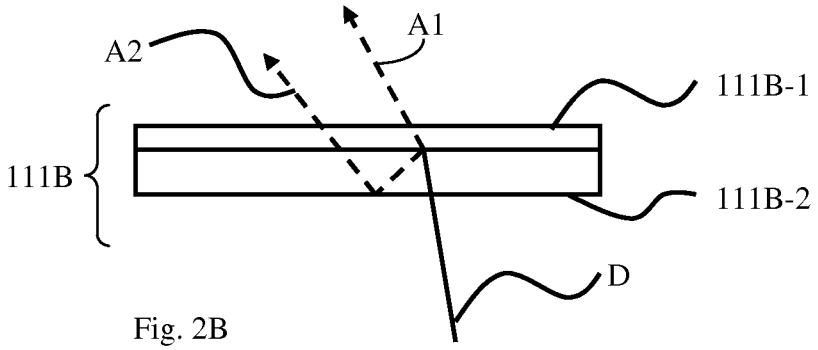

An alternative implementation, shown in FIG. 2B, is similar to the implementation shown in FIG. 2A, except that there is no air gap between the wavelength conversion material 111B-1 and the dichroic filter 111B-2 of the wavelength conversion element 111B. The dichroic filter 111B-2 may be a glass material with a dichroic coating on the lower surface. Alternatively, the dichroic coating may be on the top surface of the glass, adjacent the wavelength conversion material 111B-1, but this configuration may have a lower reflectance for the converted light. Compared to the implementation of FIG. 2A, the implementation of FIG. 2B is easier to manufacture and more efficient for heat dissipation.

Figure 2C:
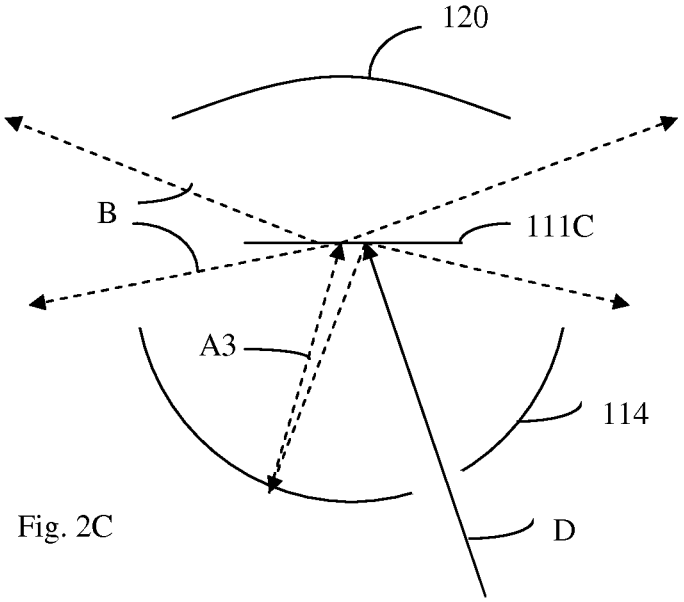
FIG. 2C illustrates another implementation of the light source of the embodiment of FIG. 2.

FIG. 2C shows a variation of the light source 110A. The lens 113 and dichroic filter 111A-2 and 111B-2 are replaced with a curved reflector 114 which reflects backward-traveling light A3 (at least the small-angle back-traveling light) from the wavelength conversion material 111C back to the itself, while the reflector 114 is provided with a small hole for allowing the excitation light D to fall on the wavelength conversion material 114. Large-angle lights B are output from either or both sides of the wavelength conversion material 111C. The reflector 120 in FIG. 2C correspond to the reflector 120 in FIG. 2.

Figure 3:
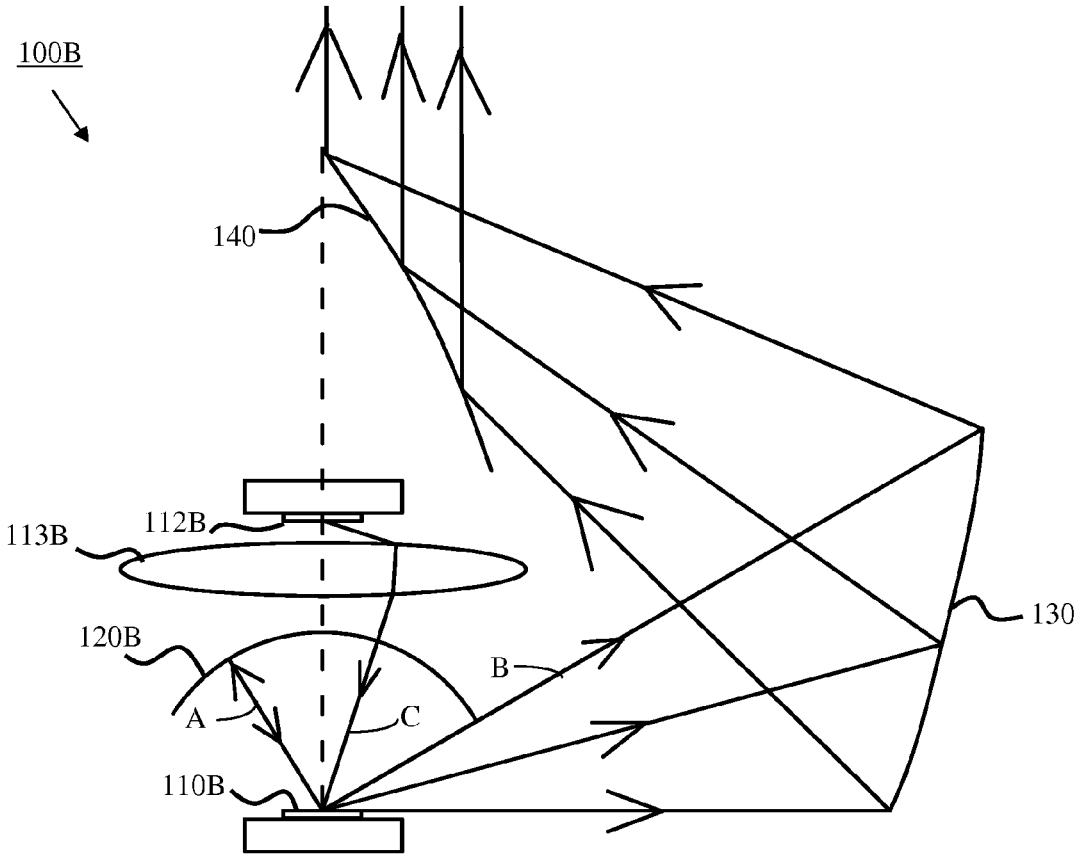
FIG. 3 illustrates a light source device according to a third embodiment of the present invention which provides a second excitation source.

FIG. 3 illustrates a light source device according to a third embodiment of the present invention. In the light source device 100B shown in FIG. 3, the light collection system (first and second collecting reflectors 130 and 140) are similar to or the same as the corresponding systems in the first embodiment shown in FIG. 1; the light recycling system (first reflector 120B) is similar to the reflector 120 in the first embodiment except that it is a dichroic element as will be explained later. The light source includes wavelength conversion materials 110B illuminated by an LED. The light source may be a an LED chip having wavelength conversion materials integrally formed with the LED chip, or it may be a wavelength conversion element illuminated by an external excitation light source similar to the light source 110A shown in FIGS. 2, 2A and 2B. In the illustrated configuration, the first excitation light illuminates the wavelength conversion material from below.

In addition, a second excitation light source 112B is provided above the first reflector 120B to excite the wavelength conversion material 110B from above. The second excitation light source 112B is preferably an LED emitting in the blue or UV region. In this embodiment, the first reflector 120B is a dichroic element which transmits the blue or UV light C from the second excitation light source 112B but reflects the converted light A from the wavelength conversion material, which has a longer wavelength range than blue or UV. This may be accomplished by coating the surface of the reflector 120B with a dichroic element. Appropriate optical elements 113B (e.g., a lens) is used to direct the second excitation light from the second excitation light source 112B to the wavelength conversion material 110B. Preferably, to enhance efficiency, the etendue of the second excitation light source 112B (including optical elements 113B) is smaller than the etendue of the wavelength conversion element 110B.

The wavelength conversion material 110B converts the second excitation light into converted light. The converted light resulting from both excitation light sources are recycled and outputted in the matter described with reference to FIG. 1.

Figure 4:
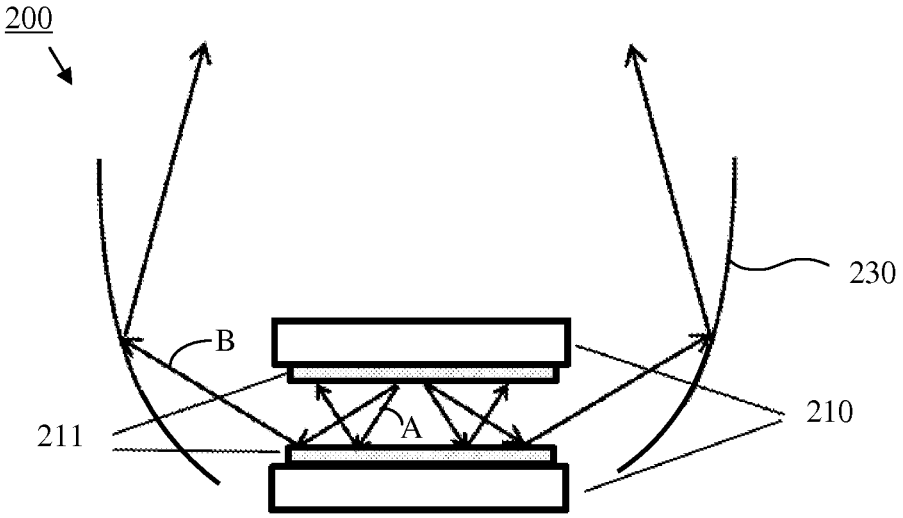
FIG. 4 illustrates a light source device according to a fourth embodiment of the present invention which uses two LEDs facing each other.

FIG. 4 schematically illustrates a light source device according to a fourth embodiment of the present invention. The light source device 200 includes two light sources, each being an LED chip 210 having wavelength conversion material 211 formed thereon. The two LED chips 210 are disposed in parallel such that the wavelength conversion materials 211 face each other. Large-angle lights B emitted by both wavelength conversion materials 211 exit to the side through the space between the two wavelength conversion materials, where the exited lights are collected by a collection system. The collection system includes a reflector 230 disposed around the two LED chips 210 to collect and output the large-angle lights. Small-angle lights A emitted by each (first) wavelength conversion material 211 fall on the surface of the other (second) wavelength conversion material and are scattered by that surface in all directions. Of the scattered lights, large-angle lights exit to the side and are collected by the light collection system 230 for output, while small-angle lights fall on the first wavelength conversion material and are scattered again in all directions. In this way, small-angle lights are recycled and large-angle lights are outputted. In the fourth embodiment, the wavelength conversion material 211 of each light source acts as the light recycling system for the other light source to recycle small-angle lights. Moreover, using two LEDs increases the brightness of the light source device.

Figure 5:
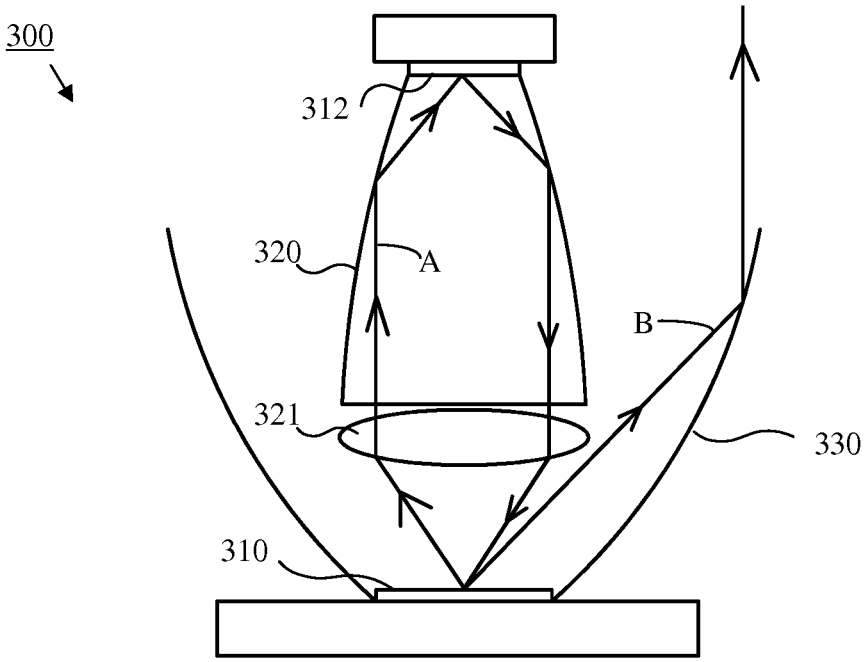
FIG. 5 illustrates a light source device according to a fifth embodiment of the present invention which uses two light sources.

FIG. 5 illustrates a light source device according to a fifth embodiment of the present invention. The light source device 300 includes first and second light sources 310 and 312 each being an LED chip with wavelength conversion material formed thereon. The two wavelength conversion materials are selected such that they do not strongly absorb the converted light of each other. The two LED chips 310 and 312 are disposed in parallel such that the wavelength conversion materials face each other. A light recycling system, including a reflector 320 and a lens 321, is disposed between the two light sources (the second light source 312 may be considered a part of the light recycling system). The reflector 320, preferably a compound parabolic concentrator (CPC), is disposed around the second light source 312. The lens 321 is disposed near the output port of the reflector 320 to direct small-angle light from the first light source into the reflector 320. A light collection system includes a reflector 330, which is disposed around the first light source 310 to reflect large-angle lights B emitted by the first wavelength conversion material for output.

The small-angle light emitted by the first light source 310 is directed into the reflector 320 and reflected to the second light source 312. The surface of the second wavelength conversion material of the second light source 312 scatter this light in all directions. The lights scattered by the second wavelength conversion material, as well as converted light emitted by the second wavelength conversion material, are reflected by the reflector 320 and directed by the lens 321 onto the surface of the first light source 310. These lights are scattered in all directions by the surface of the first wavelength conversion material of the first light source 310. Of the scattered lights, the large-angle lights are collected by the light collection system (reflector 330) for output, and the small-angle lights are again directed by the lens 321 and reflector 320 to the second light source 312. In this way, the reflector 320, lens 321 and the surface of the second light source 312 recycle the small-angle light.

Figure 6:
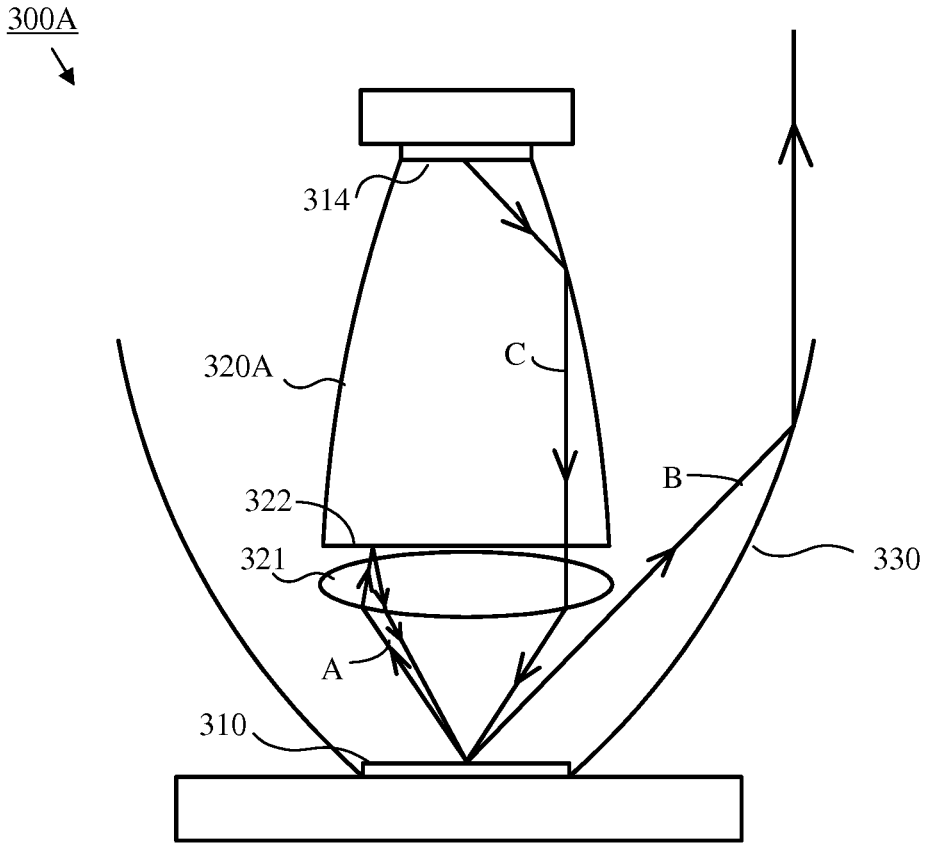
FIG. 6 illustrates a light source device according to a sixth embodiment of the present invention which uses a second excitation light source.

FIG. 6 illustrates a light source device according to a sixth embodiment of the present invention. The light source device 300A includes a first light source with wavelength conversion material 310. A second light source 314, which is an LED emitting in the blue or UV region but without a wavelength conversion material, is disposed in parallel and facing the first light source 310. The second light source 314 functions as a second excitation light source, similar to the excitation light source 112*b* in the third embodiment shown in FIG. 3. A reflector 320A disposed around the second excitation light source 314 reflects the second excitation light C and directs it via a lens 321 to the first light source 310 to excite the wavelength conversion material of the first light source.

The light collection system includes a reflector 330 disposed around the first light source 310 to reflect large-angle lights B emitted by the wavelength conversion material for output. Small-angle lights from the wavelength conversion material of the first light source 310 are directed by the lens 321 toward the reflector 320A. A dichroic element is provided in or on the reflector 320A to reflect the converted light from the wavelength conversion material 310. The dichroic element transmits blue or UV light emitted by the second excitation light source 314 but reflects the longer wavelength converted light A emitted by the wavelength conversion material 310. The reflected converted lights are directed back to the first light source 310 by the lens 321. The reflected light is scattered by the surface of the wavelength conversion material 310 in all directions. Of the scattered light, large-angle lights B are outputted by the light collecting system (reflector 330), and small-angle lights A are gathered by the lens 321 and reflected by the dichroic element 321 back to the wavelength conversion material 310. In this way, the small-angle lights are recycled by the light recycling system (lens 321 and dichroic element 322).

In the illustrated embodiment, the dichroic element 322 is located at the output port of the reflector 320A. When the reflector 320A is a solid CPC, a dichroic film may be coated on the flat output surface of the CPC. When the reflector 320A is a hollow CPC, the dichroic element may be placed inside or at the output port of the CPC. In another embodiment, the dichroic element may be formed or placed on the surface of the second excitation light source 314.

Figure 7:
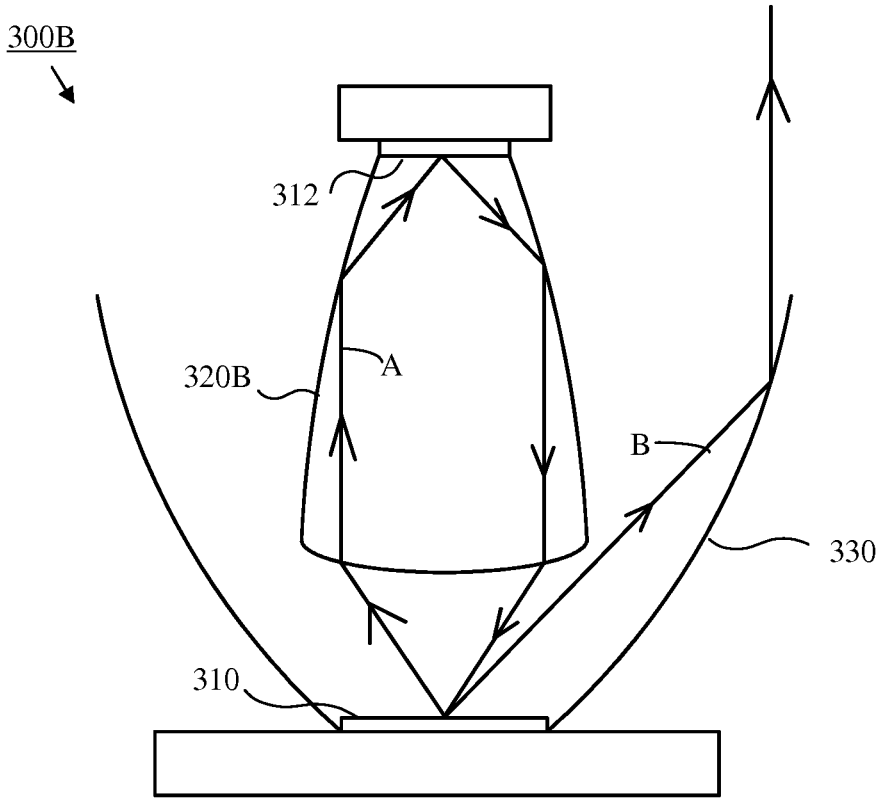
FIG. 7 illustrates a light source device according to a seventh embodiment of the present invention which is an alternative of the fifth embodiment.

FIG. 7 illustrates a light source device according to a seventh embodiment of the present invention. This embodiment is similar to the fifth embodiment shown in FIG. 5 except that the reflector (CPC) 320 and lens 321 in FIG. 5 are replaced by a solid CPC with a curved (convex) output surface 320B. Similarly (not shown), the solid CPC with a convex output surface 320B may replace the reflector 320A and lens 321 in the embodiment of FIG. 6, except that in this case the dichroic element cannot be formed on the output surface of the CPC.

In the embodiments shown in FIGS. 5, 6 and 7, the first LED 310 with first wavelength conversion material may be replaced by an external excitation light source illuminating a wavelength conversion element carrying a wavelength conversion material, similar to the light source 110A shown in FIGS. 2, 2A and 2B. Further, the wavelength conversion element may include multiple segments carrying different wavelength conversion materials (or no wavelength conversion material) and may be moveably mounted on a moving system as described in connection with FIG. 2. The second light source 312 with second wavelength conversion material in FIGS. 5 and 7 may be similarly replaced.

Preferably, in the embodiments shown in FIGS. 5, 6 and 7, the etendue of the second light source 312 or second excitation light source 314 is smaller than the etendue of the first light source material 310 to enhance efficiency.

Figure 8:
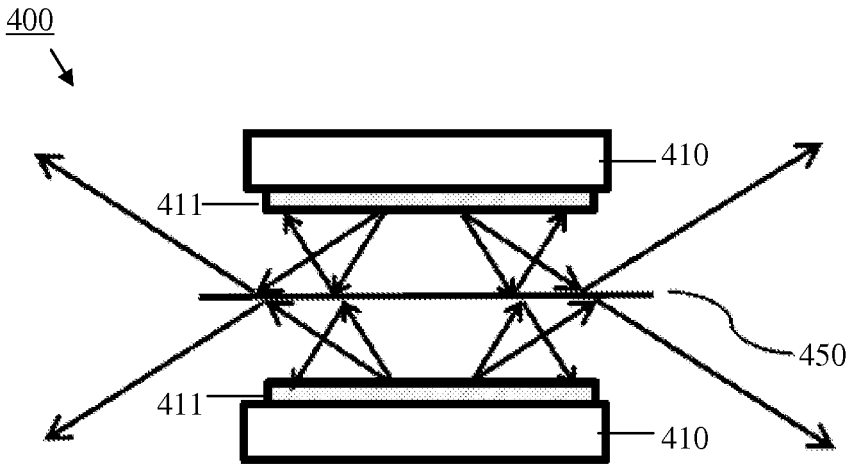
FIG. 8 illustrates a light source device according to an eighth embodiment of the present invention which uses two LEDs facing each other with a reflector between them.

FIG. 8 schematically illustrates a light source device according to an eighth embodiment of the present invention. The light source device 400 includes two light sources, each being an LED chip 410 having wavelength conversion material 411 formed there on. The two LED chips 410 are disposed in parallel such that the wavelength conversion materials 411 face each other. A light recycling system includes a flat, double-sided reflector 450 disposed between and parallel to the two wavelength conversion materials 411. The reflector 450 reflects small-angle lights from each wavelength conversion material 411 back to itself, while reflect large-angle lights toward the side so that they exit from the space between the two LED chips 410. The double-sided reflector 450 may also be a double-sided scattering surface which scatters lights in all directions. A light collection system (not shown in FIG. 8) is provided around the LED chips 410 to collect and output the large- angle light. The light collection system may include a reflector, similar to the reflector 230 shown in FIG. 4.

Figure 9:
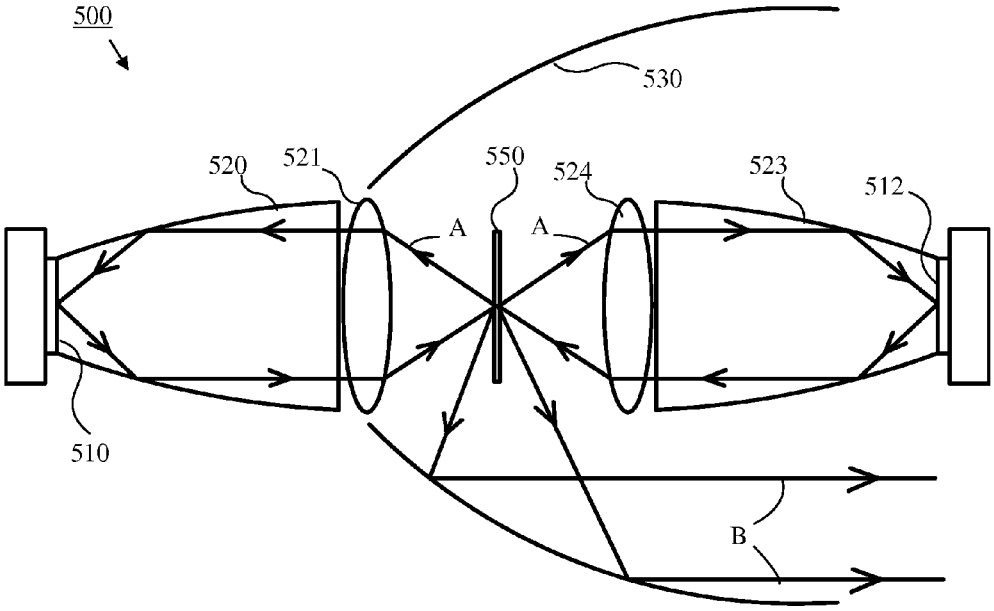
FIG. 9 illustrates a light source device according to a ninth embodiment of the present invention in which two light sources illuminate a scattering surface.

FIG. 9 illustrates a light source device according to a ninth embodiment of the present invention. The light source device 500 includes first and second light sources 510 and 512 each being an LED chip with wavelength conversion material formed thereon. The two LED chips 510 and 512 are disposed in parallel such that the wavelength conversion materials face each other. A light recycling system, including a first reflector 520 and a first lens 521, a second reflector 523 and a second lens 524, and a flat double-sided scattering surface (light diffuser) 550, is disposed between the two light sources 510, 512. The first and second reflectors 520, 523 are disposed around the first and second light sources 510, 512, respectively. The first and second lenses 521, 524 are disposed near the output port of the first and second reflectors 520 and 523, respectively. The flat double-sided scattering surface 550 is disposed between the first and second lenses 521 and 524. A light collection system including a reflector 530 is disposed around the double-sided scattering surface 550 to reflect large-angle lights B.

The light emitted by each light source 510, 512 is reflected by the respective reflector 520, 523 and then directed by the respective lens 521, 524 onto the double-sided scattering surface 550, which scatters the light in all directions. Of the scattered lights, large-angle lights B are reflected by the light collection system (reflector 530) to be output. Small-angle lights A re-enters the lenses 521, 524 and are reflected by the reflectors 520, 523 back to the respective light sources 510, 512. The reflected light is scattered by the wavelength conversion materials of the light sources 510, 512 back toward the double-sided scattering surface 550. This way, small-angle lights A are recycled by the light recycling system and large-angle lights B are output by the light collection system.

Another way to view this embodiment is that the scattering surface 550 may be deemed the light emitting surface that has a near Lambertian distribution. The large-angle lights from this light emitting surface 550 is outputted by the light collection system (reflector 530) and the small-angle lights form the light emitting surface is recycled by the light recycling system (reflector 520 and lens 521, and reflector 523 and lens 524).

In this embodiment, the first and second reflectors 520, 523 are preferably hollow or solid CPCs. Each of the CPCs 520, 523 and the respective lens 521, 524 may be replaced by a solid CPC with a curved (convex) output surface, similar to the CPC 320B shown in FIG. 7.

In this embodiment, each LED 510, 512 may be replaced by an external excitation source illuminating a wavelength conversion element carrying a wavelength conversion material, similar to the light source 110A shown in FIGS. 2, 2A and 2B. Further, the wavelength conversion element may include multiple segments carrying different wavelength conversion materials (or no wavelength conversion material) and may be moveably mounted on a moving system as described in connection with FIG. 2.

Figure 10:
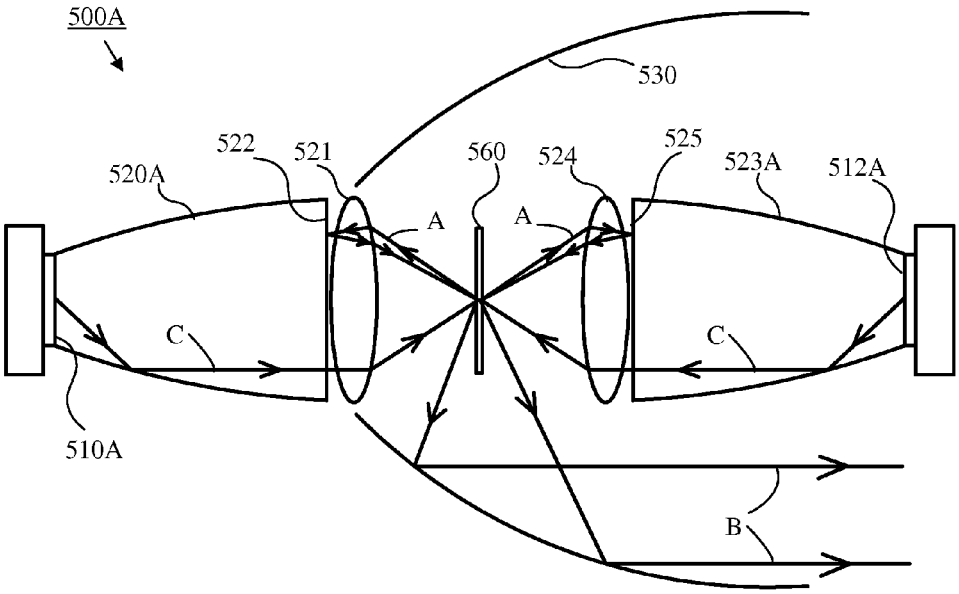
FIG. 10 illustrates a light source device according to a tenth embodiment of the present invention in which two excitation light sources illuminate a wavelength conversion material.

FIG. 10 illustrates a light source device according to a tenth embodiment of the present invention. The light source device 500A includes first and second excitation light sources 510A and 512A each being an LED chip emitting in the UV or blue range but without wavelength conversion material formed thereon. The two LED chips 510A and 512A are disposed in parallel such that they face each other. A wavelength conversion element 560 is disposed between the two excitation light sources 510A, 512A. A first and a second reflector 520A, 523A are disposed around the first and second excitation light sources 510A, 512A, respectively. A first and a second lens 521, 524 are disposed near the output port of the first and second reflectors 520A and 523A, respectively. The first reflector 520A and the first lens 521, and the second reflector 523A and the second lens 524, respectively, direct the first and second excitation lights C toward the wavelength conversion element 560 from both sides. The wavelength conversion element 560 carries a wavelength conversion material to convert the excitation lights to converted lights.

A light collection system including a reflector 530 is disposed around the wavelength conversion element 560. Large-angle converted lights B emitted by the wavelength conversion element 560 are reflected by the reflector 530 to be output. Small-angle converted lights A emitted by the wavelength conversion element 560 are directed by the lenses 521, 524 toward the reflectors 520A and 523A. Dichroic elements 522, 525 are provided at the output port of the respective reflector 520A, 523A to reflect the converted light back toward the wavelength conversion element 560 via the lenses 521, 524. The dichroic elements transmit blue or UV lights C emitted by the excitation light sources 510A, 512A but reflect the longer wavelength converted light A emitted by the wavelength conversion element 560. When the converted lights are reflected back to the wavelength conversion element 560, they are scattered by the wavelength conversion material in all directions. Of the scattered lights, large-angle lights B are reflected by the reflector 530 and output. Small-angle lights A are directed by the lenses 521, 524 to the dichroic elements 522, 525 which reflect them again. This way, small-angle lights A are recycled by the light recycling system (lenses 521, 524 and dichroic elements 522, 525) and large-angle lights B are output by the light collection system (reflector 530).

In the illustrated embodiment, the dichroic elements 522 and 525 are located at the output port of the respective reflectors 520A, 523A, but they can be located elsewhere. If the reflectors 520A, 523A are solid CPCs, a dichroic film may be coated on the flat output surface of each CPC. If the reflectors 520A, 523A are hollow CPCs, the dichroic elements may be placed inside or at the output port of the respective CPC. In another embodiment, the dichroic elements may be formed or placed on the surface of the excitation light source 510A, 512A. Further, each of the CPCs 520A, 523A and the respective lens 521, 524 may be replaced by a solid CPC with a curved (convex) output surface, similar to the CPC 320B shown in FIG. 7; however, in such a case the dichroic elements cannot be coated on the output surface of the CPCs.

In the ninth embodiment shown in FIG. 9, both light sources 510 and 512 are LEDs with wavelength conversion materials. In the tenth embodiment shown in FIG. 10, both light sources 510A and 512A are LEDs emitting an excitation light without wavelength conversion materials.

In an alternative embodiment, one of the light sources is an LED carrying a wavelength conversion material (e.g. 510), and the corresponding side of the flat element 550/560 is a scattering surface, while the other one of the light sources is an LED emitting an excitation light (blue or UV) without a wavelength conversion material, and the corresponding side of the flat element 550/560 carries a wavelength conversion material.

One advantage of the embodiments of FIGS. 3 to 10 is that, because two LED chips are used, the overall brightness of the light source device is further increased.

Figure 11:
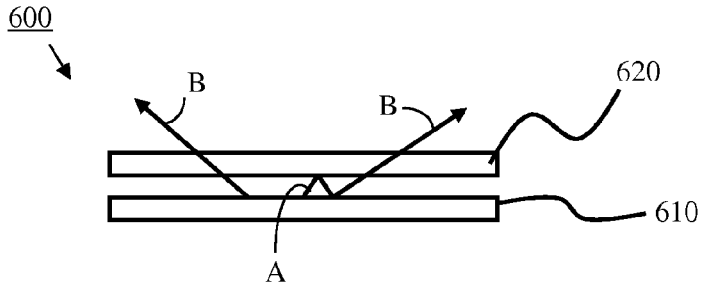
FIG. 11 illustrates a light source device according to an eleventh embodiment of the present invention in which an angle-selective dichroic filter is used to recycle small-angle light.

FIG. 11 illustrates a light source device according to a tenth embodiment of the present invention. The light source device 600 includes a light source 610 and an angle-selective dichroic element 620 disposed above the light source 610 that acts as the light recycling system. The dichroic element 620 reflects small-angle light and transmits large-angle light. This light source device does not require a reflector to recycle small-angle lights. A light collection system (not shown) is provided around the light source 610 and dichroic element 620 to collect large-angle light for output.

The light source 610 may be an LED or a wavelength conversion element carrying a wavelength conversion material. In the latter case, an excitation light source (not shown) is provided to excite the wavelength conversion material, similar to the light source 110A shown in FIG. 2, and a filter similar to filters 111A-2 and 111B-2 shown in FIGS. 2A and 2B may be provided to reflect backward-traveling lights toward the forward direction. In addition, the wavelength conversion element 610 may include multiple segments carrying different wavelength conversion materials (or no wavelength conversion material), and may be moveably mounted on a moving system such as a rotating wheel such that the different segments of the wavelength conversion element is alternatingly exposed to the light of the excitation light source.

Figure 11A:
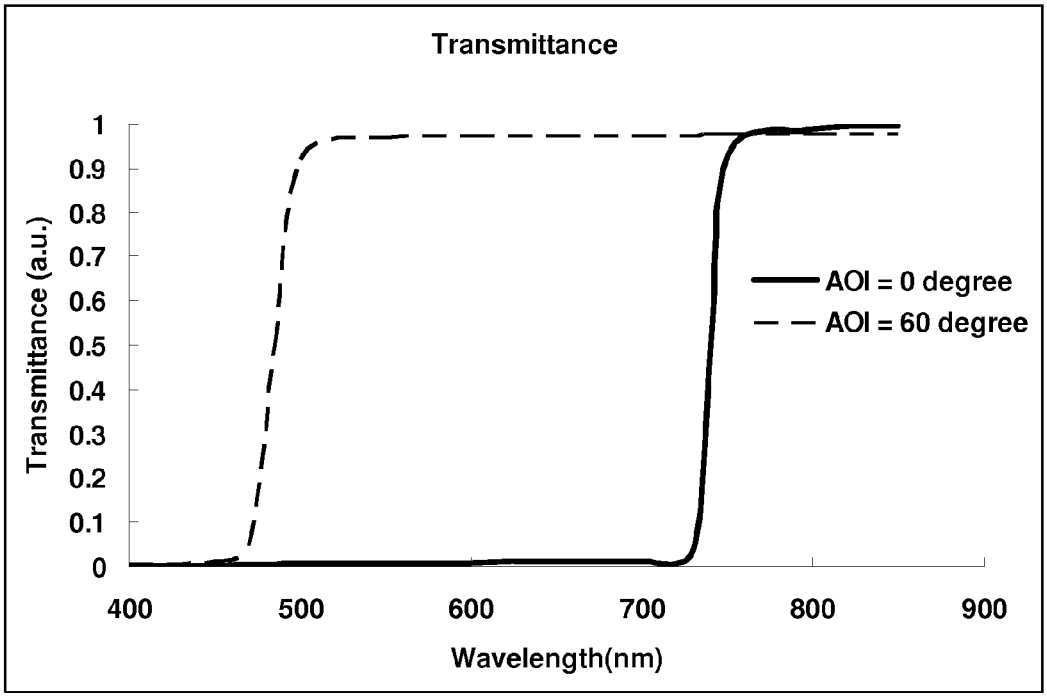
FIG. 11A illustrates an exemplary transmittance graph of the dichroic filter of FIG. 11.

FIG. 11A illustrates an exemplary transmittance graph of the dichroic element 620. At small angles of incidence (e.g. AOI=0 degrees), the transmittance is low for the wavelengths of interest (for example, the wavelengths of the converted light emitted by the wavelength conversion material typically fall within the 500 nm to 700 nm range). At larger angle of incidence (e.g. AOI=60 degrees), the transmittance is high for the wavelengths of interest. In other words, the dichroic element reflects small-angle lights and transmits large-angle lights for the wavelengths of interest.

Therefore, as shown in FIG. 11, of the light emitted by the light source 610, large-angle lights B pass through the dichroic element 620 and is output; small-angle lights A are reflected by the dichroic element 620 back to the light source 610, which scatters the light in all directions. Of the scattered light, large-angle lights are output and small-angle lights are again recycled.

Preferably, to achieve better recycling efficiency, the dichroic element 620 is located adjacent to the light source 610.

Angle-selective filters have been described as an output device for LED light sources. For example, U.S. Pat. No. 8,008,694 describes using an angle selective filter which reflects large-angle lights and transmits small-angle lights. Using an angle-selective filter that recycles small-angle light and outputs large-angle light as in the present embodiment avoids potential problems of loss of recyclable lights through leakage from the edge of the light source.

Figure 12:
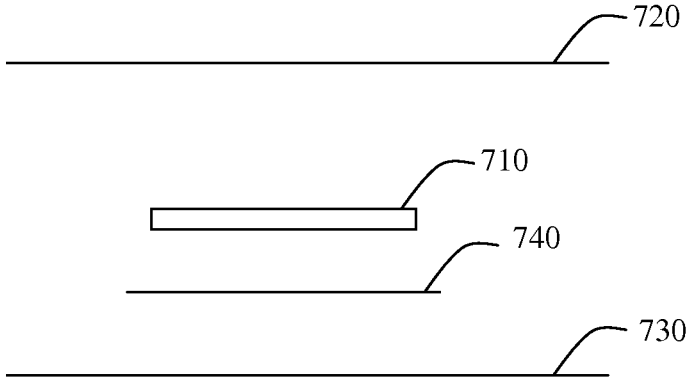
FIG. 12 schematically illustrates a light source device, showing the various functional components of the device

In the embodiments described above, the light emitting surface is either a surface that emits light or a surface that scatters light or a surface that both emits and scatters light. The actual structure may include one layer that both emits and scatters, or two separate layers as schematically illustrated in FIG. 12. FIG. 12 shows a light source device 700 that includes the following functional components: a sheet shaped light source 710, a first and a second reflector 720 and 730 disposed on both sides of the light source 710, and at least one light diffuser 740 disposed between the two reflectors 720 and 730. It should be noted that this illustration is highly schematic and does not necessarily represent the actual shape and position of the components. The light source 710 may emit light in one side or both sides. In practice, the light source typically emits light in all directions, i.e., having a near-Lambertian distribution. Both reflectors 720 and 730 reflect small-angle light back toward the light source 710 (or the diffuser 740). At least one of them does not reflect large-angle light from the source, i.e. it will permit large-angle light to be output. The light collecting system for outputting the large-angle light is not shown in FIG. 12. The diffuser 740 which locates between the two reflectors 720 and 730, diffuses (scatters) light falling upon it from the light source 710 or the reflector(s) 720 and/or 730 into a range of directions. The spatial relationship between the diffuser 740 and the light source 710 is not limited to any particular arrangement. Moreover, the diffuser 740 and the light source 710 may be physically the same structure that performs both emitting and diffusing functions. In this structure, the small-angle lights emitted from the light source 710 will be reflected to and fro; each time the lights go through the diffuser, some of it will be diffused to become large-angle lights and then output; as a result, most of the originally small-angle light will output at large angles during this recycling process.

The functional components of the light source device 700 shown in FIG. 12 are present in various forms in the first through eleventh embodiments described earlier. In the first and sixth embodiments (FIGS. 1 and 6), the LED 110/310 combines the functions of the light source 710, diffuser 740 and second reflector 730, where a surface inside the LED acts as the second reflector to reflect lights of all angles and the upper surface of the LED acts as the diffuser and light source. In the second embodiment (FIGS. 2, 2A and 2B), the wavelength conversion material 111A-1/111B-1 acts as the light source and the diffuser, and the dichroic filter 111A-2/111B-2 acts as the second reflector to reflect converted lights of all angles and transmit the excitation light. In the implementation of the second embodiment shown in FIG. 2C, the wavelength conversion material 111C acts as the light source and the diffuser, and the reflector 114 acts as the second reflector. In the fourth, fifth and seventh embodiment (FIGS. 4, 5 and 7), two light sources 211/310/312 and two diffusers 211/310/312 are present and each element 211/310/312 acts as both a light source and a diffuser. In the eighth and ninth embodiments (FIGS. 8 and 9), the light sources 411/510/512 and the diffuser 450/550 are physically separate elements. In the tenth embodiment (FIG. 10), the wavelength conversion material 560 acts as both the light source and the diffuser, and the reflectors 522/525 act as the first and second reflectors. In the eleventh embodiment (FIG. 11), the angle-selective dichroic filter 620 acts as the first reflector, the light source 610 acts as the light source, diffuser and the second reflector.

In another implementation of the configuration of FIG. 12, the diffuser 740 and the second reflector 730 are realized by a single element which is a white diffuser located below the light source 710 (e.g. adhered to the back of the light source 710).

In the above descriptions, it should be appreciated that when the light is said to be emitted and scattered in "all directions", it is meant that the light is emitted or scattered in a wide range of directions.

The light source devices according to various embodiments described here can be used in application such as projectors, headlamps, spot lights, search lights, etc.

It will be apparent to those skilled in the art that various modification and variations can be made in the light source device of the present invention without departing from the spirit or scope of the invention. Thus, it is intended that the present invention cover modifications and variations that come within the scope of the appended claims and their equivalents.

What is claimed is:

1. A light source device comprising:

a first light source having a light emitting surface which emits lights and/or scatters lights into a range of directions including small-angle lights and large-angle lights, the small-angle lights having smaller angles with respect to a normal direction of the light emitting surface than the large-angle lights;

a light recycling system, including at least one reflector disposed on one side of the first light source, for directing the small-angle lights back to the first light source; and a light collection system for collecting and outputting the large-angle lights, wherein the light recycling system and the light collection system are separate from each other.

2. The light source device of claim 1, wherein the at least one reflector of the light recycling system includes one or more spherical reflector, a compound parabolic concentrator, or a flat reflector.

3. The light source device of claim 1, wherein the at least one reflector of the light recycling system include an angle-selective filter disposed adjacent the light emitting surface which reflects small-angle lights and transmits large-angle lights.

4. The light source device of claim 1, wherein the light collection system comprises one or more reflectors, or one or more prisms, or a combination of one or more reflectors and one or more prisms disposed around the first light source.

5. The light source device of claim 1, wherein the first light source includes a light emitting diode, and wherein the light emitting surface is a surface of the light emitting diode.

6. The light source device of claim 1, wherein the first light source includes:

a first light emitting diode emitting a first excitation light having a first wavelength; and a wavelength conversion element having at least one wavelength conversion material which absorbs the first excitation light emitted by the first light emitting diode and emits a converted light having a wavelength longer than the first wavelength, and wherein the light emitting surface is a surface of the wavelength conversion material.

7. The light source device of claim 6, wherein the wavelength conversion element has two or more different wavelength conversion materials, the wavelength conversion element being moveable to alternatingly expose the two or more different wavelength conversion materials to the first excitation light.

8. The light source device of claim 6, further comprising a delivery optical element for delivering the first excitation light from the first light emitting diode to the wavelength conversion element.

9. The light source device of claim 8, wherein the wavelength conversion element further includes a dichroic filter disposed between the wavelength conversion material and the delivery optical element, for reflecting backward-traveling converted light in a forward direction toward the light recycling system.

10. The light source device of claim 9, wherein an air gap is provided between the dichroic filter and the wavelength conversion material.

11. The light source device of claim 6, further comprising:

a second light emitting diode emitting a second excitation light having a second wavelength; and an optical system cooperating with the light recycling system to direct the second excitation light to the wavelength conversion material, wherein the wavelength conversion material absorbs the second excitation light emitted by the second light emitting diode and emits a converted light having a wavelength longer than the second wavelength.

12. The light source device of claim 11, wherein the second light emitting diode is disposed behind the light recycling system, and wherein the light recycling system includes a dichroic element that reflects the converted light and transmits the second excitation light.

13. The light source device of claim 12, wherein the optical system includes a hollow or solid compound parabolic concentrator (CPC) and the dichroic element is disposed at an output port of the CPC.

14. The light source device of claim 1, wherein the light recycling system includes:

a second light source having a light emitting surface for emitting a second light; and an optical system, including one or more reflectors disposed between the first light source and the second light source, for directing the small-angle lights from the first light source toward the light emitting surface of the second light source, wherein the light emitting surface of the second light source reflects or scatters the light from the first light source back to the first light source via the optical system, and wherein the optical system directs the second light from the second light source to the light emitting surface of the first light source.

15. The light source device of claim 14, wherein the optical system includes a hollow compound parabolic concentrator (CPC) and a lens disposed near an output port of the hollow CPC, or a solid CPC and a lens disposed near an output port of the solid CPC, or a solid CPC having a curved output surface.

16. The light source device of claim 1, wherein the light emitting surface of the first light source includes a scattering surface which scatters lights into a range of directions.

17. The light source device of claim 1, wherein the first light source comprises:

a sheet shaped light source which emits lights; and a light diffuser which diffuses light falling upon it into a range of directions including small-angle lights and large-angle lights, the small-angle lights having smaller angles with respect to a normal direction of the light diffuser than the large-angle lights, the light diffuser being different from the light source;

wherein the light recycling system includes two reflectors, wherein the light source and the light diffuser are located between the two reflectors of the light recycling system, and wherein the two reflectors direct the small-angle lights from the light diffuser back to the light diffuser.

18. A light source device comprising:

a first and a second light source, each having a light emitting surface which emits and scatters lights in a range of directions including small-angle lights and large-angle lights, the small-angle lights having smaller angles with respect to a normal direction of the light emitting surface than the large-angle lights, the light emitting surfaces of the first and second light sources being arranged in parallel and facing each other;

a light recycling system disposed between the first and second light sources, for receiving light emitted from the second light source and small-angle light emitted from the first light source, and directing the received light to one or both of the light emitting surfaces of the first and second light sources; and a light collection system for collecting and outputting large-angle lights from the first light source;

wherein the light recycling system and the light collection system are separate from each other.

19. The light source device of claim 18, wherein the optical system includes a hollow compound parabolic concentrator (CPC) or a solid CPC.

20. The light source device of claim 18, wherein the optical system includes a hollow compound parabolic concentrator (CPC) and a lens disposed near an output port of the hollow CPC, or a solid CPC and a lens disposed near an output port of the solid CPC, or a solid CPC having a curved output surface.

* * * * *